United States Patent [19]

Hall et al.

[11] Patent Number: 4,611,878

[45] Date of Patent: Sep. 16, 1986

[54] ELECTRICAL PLUG CONNECTOR

[75] Inventors: Lawrence A. Hall, Harrisburg; Linn S. Lightner; William B. Long, both of Camp Hill; Suel G. Shannon, Harrisburg; Daniel E. Stahl, Hummelstown, all of Pa.

[73] Assignee: AMP Incorporated, Harrisburg, Pa.

[21] Appl. No.: 691,620

[22] Filed: Jan. 15, 1985

Related U.S. Application Data

[63] Continuation of Ser. No. 462,278, Jan. 31, 1983, Pat. No. 4,493,525.

[51] Int. Cl.[4] ..... H01R 13/629; H01R 23/06

[52] U.S. Cl. ..... 339/186 M; 339/143 R; 339/141

[58] Field of Search ..... 339/14 R, 143 R, 176 M, 339/176 MP, 217 S, 189 M, 182, 186 M, 103 M, 141

[56] References Cited

U.S. PATENT DOCUMENTS

| | | | |
|---|---|---|---|
| 2,905,922 | 9/1959 | Tuchel | 339/141 |
| 4,310,213 | 1/1982 | Fetterolf et al. | 339/103 M |
| 4,337,989 | 7/1982 | Asick et al. | 339/143 P |

*Primary Examiner*—Eugene F. Desmond
*Attorney, Agent, or Firm*—Adrian J. LaRue; Anton P. Ness

[57] ABSTRACT

An electrical connector of the plug type comprises a dielectric housing member in which electrical terminals are secured, contact sections of the electrical terminals extend outwardly from a front surface of the dielectric housing member, and conductor-securing sections of the electrical terminals are to be connected to electrical conductors of a shielded cable. Metal clamshell members are mounted on the dielectric housing member forming an outer contact surrounding the dielectric housing member so that a front section covers the contact sections of the electrical terminals and a rear section is to be connected to a shield of the shielded cable. An insulating sleeve is disposed on the clamshell members and the cable. The conductor-securing sections are electrically connected to the electrical conductors and the electrical terminals are latchably secured in terminal passageways of the dielectric housing member, the rear section of the outer conductor has the shield positioned thereon so that a ferrule member can be crimped onto the rear section crimping the shield between the rear section and the ferrule member and, securing the clamshell members in position on the dielectric housing, the ferrule member is also to be crimped onto an insulating jacket of the cable. The forward section of the outer contact has an axial indentation aligned with a peripheral recess at the front of the housing member which polarizes the plug connector when mated with a receptacle connector having a corresponding peripheral recess at the front of its housing.

5 Claims, 4 Drawing Figures

ELECTRICAL PLUG CONNECTOR

RELATED APPLICATION INFORMATION

This is a continuation application of U.S. patent application Ser. No. 462,278 filed Jan. 31, 1983, now U.S. Pat. No. 4,493,525.

FIELD OF THE INVENTION

This invention relates to electrical connectors and electrical plug connectors and receptacles therefor of the DIN type.

BACKGROUND OF THE INVENTION

Electrical connectors of the DIN type are known and they include a dielectric housing in which three to eight electrical terminals are molded. The terminals are soldered to electrical conductors of a shielded cable. Metal clamshell members are mounted onto the housing with one of the clamshell members having a U-shaped ferrule that is crimped onto the metal shield of the cable to terminate the shield and provide strain relief. An insulating strain relief member is disposed or molded onto the clamshell members and engages the cable adjacent the U-shaped ferrule thereby holding the clamshell members in position on the housing and providing a strain relief.

Soldering of conductors to terminals is time-consuming and cold solder connections can take place. The crimping of the U-shaped ferrule onto the metal shield does not result in a good termination or an effective strain relief. If the insulating strain relief member is pushed onto the clamshell members, this is not a desirable approach to holding the clamshell members in position. If the insulating strain relief member is molded onto the clamshell members, the open area of the back end of the clamshell members must be covered or viscous dielectric material positioned therein prior to molding to prevent material of the strain relief member from entering the soldered terminations which may break the terminations.

SUMMARY OF THE INVENTION

According to the present invention, an electrical connector of the plug type comprises a dielectric housing member in which electrical terminals are secured, contact sections of the electrical terminals extend outwardly from a front surface of the dielectric housing member, and conductor-securing sections of the electrical terminals are to be connected to electrical conductors of a shielded cable. Metal clamshell members are mounted on the dielectric housing member forming an outer contact surrounding the dielectric housing member so that a front section covers the contact sections of the electrical terminals and a rear section is to be connected to a shield of the shielded cable. An insulating sleeve is disposed on the clamshell members and the cable. The conductor-securing sections are electrically connected to the electrical conductors and the electrical terminals are latchably secured in terminal passageways of the dielectric housing member, the rear section of the outer contact has the shield positioned thereon so that a ferrule member can be crimped onto the rear section crimping the shield between the rear section and the ferrule member and, securing the clamshell members in position on the dielectric housing, the ferrule member is also to be crimped onto an insulatng jacket of the cable.

The outer contact has an axial indentation at the front which when aligned with a recess in the periphery of the housing at the front, will provide proper angular orientation upon mating with a receptable connector having a corresponding recess in the periphery of its housing at the front. The axial indentation will be disposed in the corresponding recess of the receptacle housing when the receptacle housing enters the forward section of the plug connector's outer contact.

DETAILED DESCRIPTION OF THE INVENTION

Figure 1:
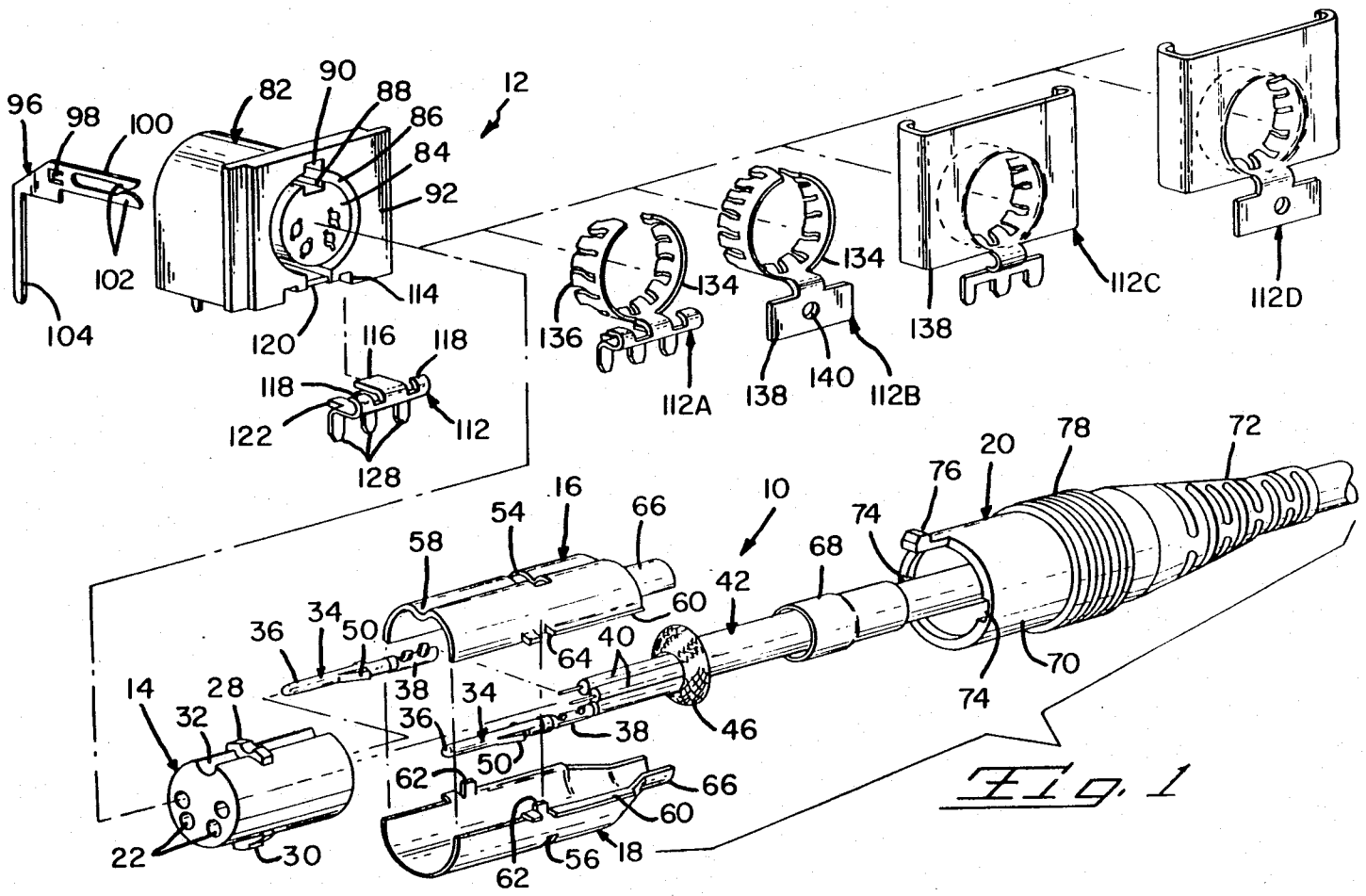
FIG. 1 is an exploded and perspective view of the parts of the electrical plug connector and receptacle therefor.

A plug connector 10 and receptacle 12 therefor is illustrated in the drawings and they are electrically matable with one another to interconnect a wide variety of electronic equipment, especially computer equipment. Plug connector 10 comprises a dielectric housing 14, clamshell members 16 and 18, and a cable guard member 20.

Figure 3:
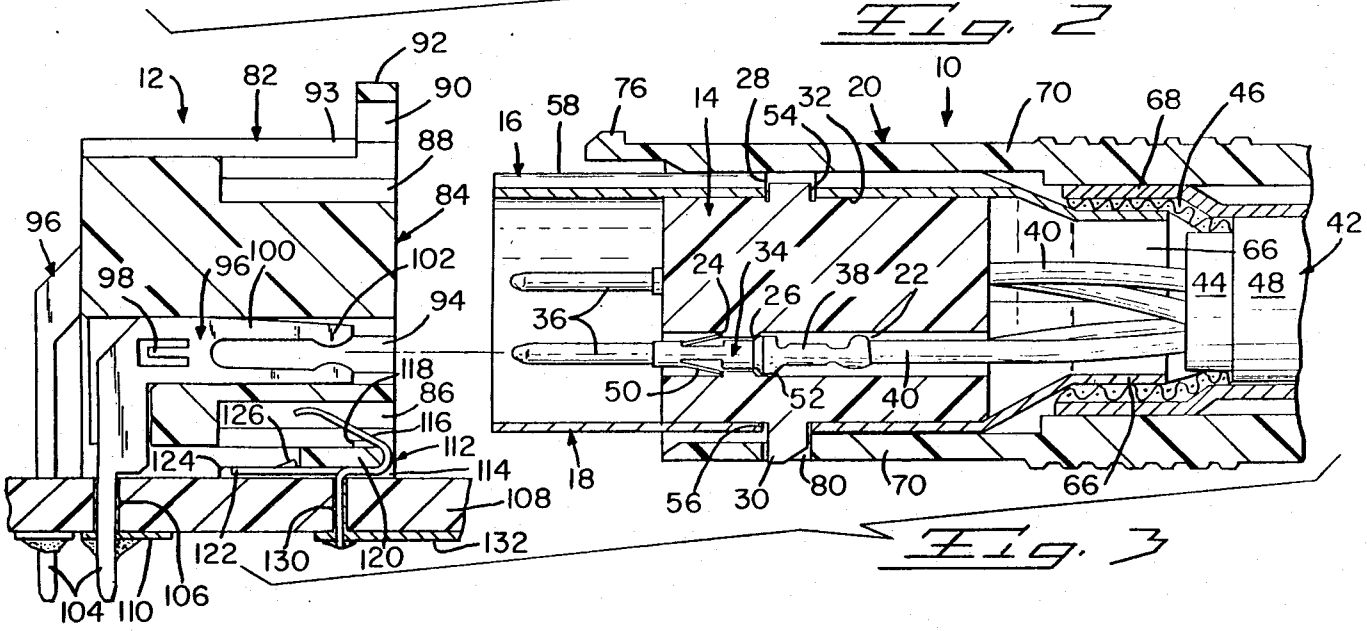
FIG. 3 is a longitudinal section view of FIG. 2.
Figure 4:
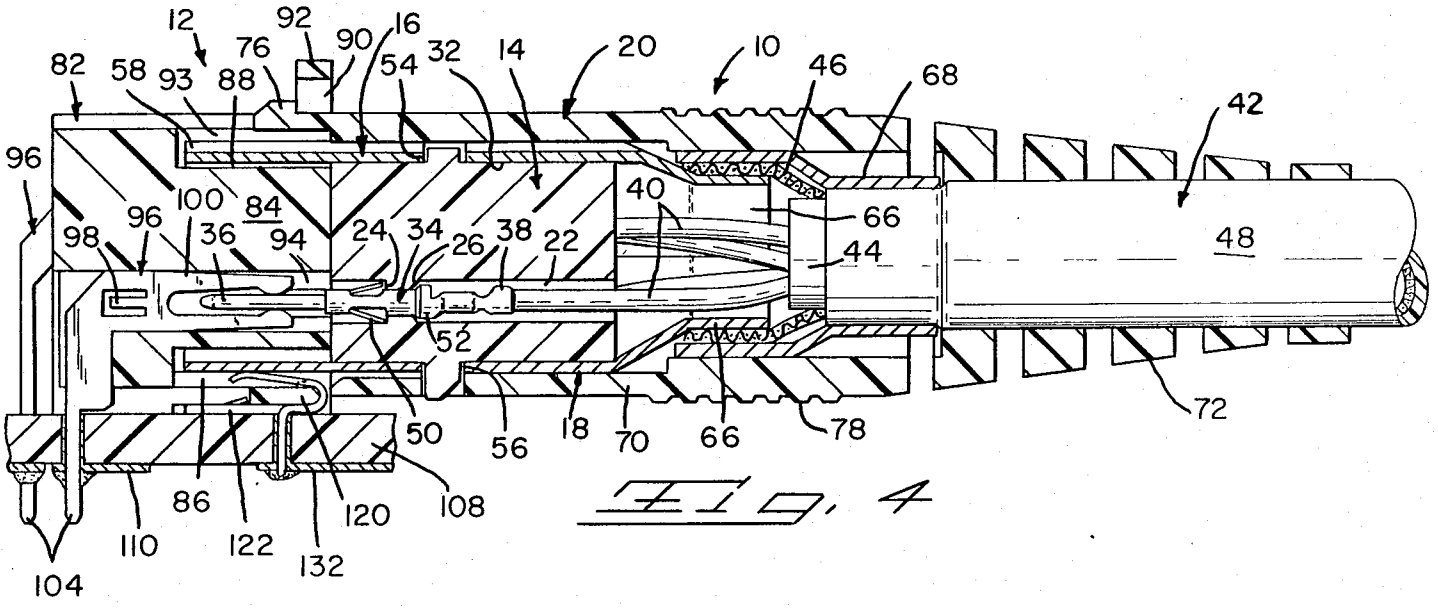
FIG. 4 is identical to FIG. 3 but with the plug connector and receptacle in mated electrical engagement.

Dielectric housing 14 is molded from a suitable plastic material and has terminal-receiving passageways 22 extending therethrough and preferably varies in number from three to eight. As shown in FIGS. 3 and 4, each of terminal-receiving passageways 22 has a forward retention surface 24 and a rear stop surface 26. Projections 28, 30 extend outwardly from housing 14 and a U-shaped recess 32 extends along housing 14 on each side of projection 28 and passes therethrough.

Electrical terminals 34 are stamped and formed from a suitable metal in accordance with conventional stamping and forming operations and they include pin contact sections 36 and conductor-securing sections 38 which are crimped in accordance with conventional crimping practices onto the conductive cores of insulated electrical conductors 40 of a shielded electrical cable 42. As shown, cable 42 has insulated electrical conductors 40 positioned within an inner dielectric sheath 44 around which is disposed a braided metallic shield 46 that is covered by an outer insulating jacket 48. Alternatively, shielded electrical cable 42 can be formed with electrical conductors twisted together and wrapped with a thin plastic film and the shield can be in the form of a thin metal foil wrapped around the plastic film encased electrical conductors with a stranded electrical wire extending along the cable within the wrapped metal foil. The cable can, of course, take other forms as desired.

After cable 42 has been stripped to expose the conductive cores of electrical conductors 40 and a suitable amount of shield 46, conductor-securing sections 38 of electrical terminals 34 are crimped onto the conductive cores of electrical conductors 40 whereafter terminated terminals 34 are latchably secured in terminal-receiving passageways 22 of housing 14 via spring lances 50 engaging forward retention surfaces 24 and stop sections 52 of conductor-securing sections 38 engaging rear stop surfaces 26 so that pin contact sections 36 extend outwardly from the forward surface of housing 14 as shown in FIGS. 3 and 4. In this way, electrical terminals 34 are latchably secured in passageways 22 for removal therefrom by depression of lances 50 to clear surfaces 24 if desired. Moreover, conductor-securing sections 38 of electrical terminals 34 are completely enclosed within housing 14.

Clamshell members 16 and 18, which are stamped and formed from suitable metal, are U-shaped and are now positioned on housing 14 with projections 28 and 30 extending through openings 54 and 56 in members 16 and 18 respectively. Clamshell member 16 at the front end thereof has an inwardly-directed arcuate projection 58 extending axially rearwardly from the front edge thereof while retaining a continuous surface thereat, and projection 58 is disposed in U-shaped recess 32 of housing 14. Members 16 and 18 have flanges 60 that engage each other and lugs 62 on member 18 are disposed in recesses 64 of flanges 60 on member 16 to position members 16 and 18 relative to one another prior to members 16 and 18 being secured together. Clamshell members 16 and 18 are necked down at their rear ends to smaller U-shaped sections 66 which form an annular member surrounding conductors 40 onto which braid 46 is positioned and ferrule member 68, which has been slidably positioned on cable 42, is moved onto the shield and controllably crimped onto the annular member and the outer jacket 48 to electrically connect shield 46 between ferrule member 68 and the annular member thereby forming an excellent mechanical and electrical connection as well as a strain relief for cable 42 in addition to securing clamshell members 16 and 18 onto housing 14 so that clamshell members 16 and 18 form an outer contact for the plug connector with a forward section surrounding contact sections 36 as shown in FIGS. 3 and 4.

Figure 2:
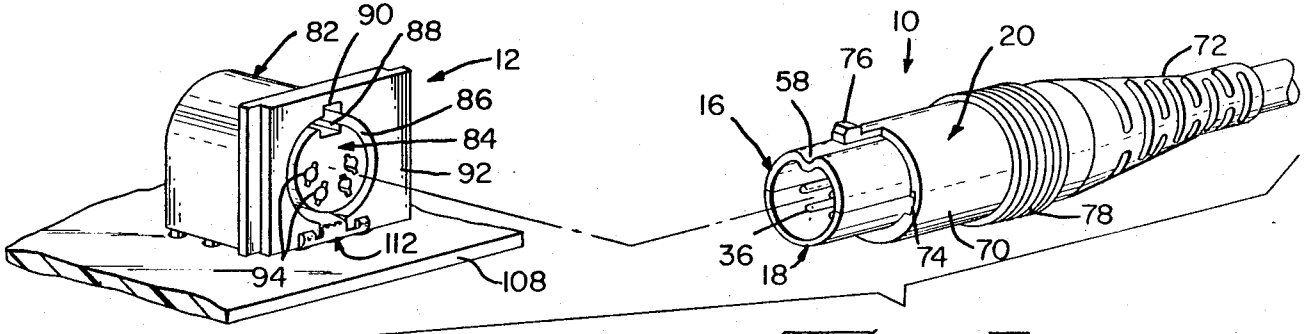
FIG. 2 is a perspective view of the assembled receptacle and plug connector but exploded from each other.

Cable guard member 20 is molded from a suitable plastic material and includes a clamshell-engaging section 70 and a cable-engaging section 72. Cable-engaging section 72 comprises a plurality of concentrically molded and connected rings of external decreasing diameter towards the rear end which are dimensioned to closely receive cable 42 therethrough as shown in FIG. 4. The rings serve to resiliently reinforce cable 42 from extreme lateral manipulation thereof. After clamshell members 16 and 18 have been secured in position on dielectric housing 14 via ferrule member 68, cable guard member 20 after having been positioned onto cable 42 is moved along cable 42 with clamshell-engaging section 70 being positioned onto clamshell members 16 and 18 as shown in FIGS. 2 through 4. Section 70 has diametrically opposed internal slots 74 into which flanges 60 of members 16 and 18 are disposed and they are wide enough to permit member 20 to rotate about 30° relative to clamshell members 16 and 18. A latching hook 76 extends outwardly from the front end of section 70 and a series of ribs 78 extend outwardly from the outer surface of section 70 adjacent section 72. As can be discerned, section 70 covers clamshell members 16 and 18 so that the forward end of section 70 is coincident with the forward surfce of housing 14 as shown in FIGS. 3 and 4 and an opening 80 is located in section 70 to permit projection 30 of housing 14 to be disposed therein to maintain housing 14 and cable guard member 20 in position on clamshell members 16 and 18.

Receptacle 12 comprises a dielectric housing 82 which is molded from a suitable dielectric material such as, for example, glass-filled nylon or the like, and it includes a terminal-receiving section 84 which is surrounded by a channel 86. A U-shaped recess 88 is located in terminal-receiving section 84 and is in communication with channel 86. An oppositely-dispoed U-shaped recess 90 is located in hood section 92. Terminal-receiving passageways 94 extend through terminal-receiving section 84 in alignment with respective terminal-receiving passageways 22 in dielectric housing 14 of plug connector 10 and they include diametrically-opposed recesses in communication therewith as shown in FIGS. 1 and 2. Electrical terminals 96 are disposed in terminal-receiving passageways 94 and are secured therein by lances 98 in engagement with stop surfaces (not shown) located within the passageways. Electrical terminals 96 have forked contact sections 100 which are located in the opposed recesses of the passageways and the free ends of contact sections 100 are provided with arcuate contact surfaces 102 on the inner surfaces thereof for wiping and spring electrical contact with pin contact sections 36 of electrical terminals 34 when the plug connector 10 is electrically mated with receptacle 12 as shown in FIG. 4. Other contact sections 104 of electrical terminals 96 are disposed at right angles with respect to forked contact sections 100 and they extend through holes 106 in printed circuit board 108 for electrical connection with respective conductive paths 110 by solder connection therewith. Contact sections 104 can be in the form of ACTION PIN contacts (trademark of AMP Incorporated) for electrical connection with plated through holes in the printed circuit board or the conductive paths.

Ground terminal 112 is positioned within a recess 114 in housing 82 with spring contact member 116 in the form of a cantilever beam extending into channel 86 while hook members 118 engage the top surface of support member 120 within recess 114 and legs 122 of ground terminal 112 are disposed in bottom recess 124 with lances 126 of legs 122 in engagement with the rear surface of support 120 through an opening in the bottom surface of the housing 82 in communication with channel 86, thereby latchably securing ground terminal 112 in position in housing 82 as shown in FIGS. 3 and 4. In this way, the front section of clamshell members 16 and 18 forming the outer contact of plug connector 10 is electrically connected with spring contact 116 of ground terminal 112 when this forward section is positioned in channel 86 as shown in FIG. 4 with arcuate projection 58 being disposed in U-shaped recess 88 thereby polarizing plug connector 10 in receptacle 12. After plug connector 10 has been matably connected within receptacle 12 and illustrated in FIG. 4, member 20 is rotatably so that latching hook 76 is moved into engagement with the rear surface of hood section 92 through an opening 93 in the top of housing 82 in communication with recess 90 and channel 86, thereby latchably securing plug connector 10 in position in receptacle 12. Ground terminal 112 has other contact sections 128 which extend through holes 130 in printed circuit board 108 for electrical connection via soldering to ground plane 132.

Other embodiments of the ground terminal are illustrated in FIG. 1 with ground terminal 112A being the same as ground terminal 112 with the exception that spring contact member 116 is replaced by an almost circular contact 134 having spring contacts 136 which is disposed in channel 86 for electrical engagement with the forward section of the outer contact of plug connector 10. Ground terminal 112B has circular contact 134 but includes a planar contact 138 which is electrically connected to a metal chassis by screw through hole 140 to form the ground connection therewith. Ground terminal 112C is the same as ground terminal 112A except that the circular contact 134 is formed from planar metal which is clinched onto hood section 92 and ground terminal 112D is a combination of ground terminal 112C and ground terminal 112B. Ground terminals 112A, 112B, 112C and 112D provide excellent connection as well as EMI protection.

As can be discerned, a plug connector has been described that is easy to assemble to securely maintain the clamshell members in engagement and to form an excellent electrical and mechanical connection between the conductors and shield of the cable and the contacts and outer contact of the connector. A receptacle for the plug connector has also been described that is easy to assemble and solder or connect to circuit paths and a ground plane of a circuit board as well as to provide excellent EMI protection for the connection between the plug connector and receptacle.

We claim:

1. A plug connector for electrical connection to insulated electrical conductors and a shield of a shielded cable and being matable in a polarized relationship with a receptacle connector having an outwardly facing axially disposed channel extending peripherally rearwardly from the mating face thereof, said plug connector comprising:

dielectric housing means having terminal passageways extending therethrough, said terminal passageways having stop surfaces therein, said housing means having recess means therein;

electrical terminal means having contact means, conductor-securing securing means and latching means, said conductor-securing means being securable to the electrical conductors and thereafter being positioned in said terminal passageways with said latching means engaging said stop surfaces thereby latchably securing said electrical terminal means in said housing means such that said contact means extend outwardly from a forward end of said housing means and said conductor-securing means are disposed within said terminal passageways;

outer contact means for disposition on said housing means and having forward section means surrounding said contact means, and further having rear section means in the form of a substantially annular section onto which an end of the shield is to be disposed;

ferrule means positionable onto said annular section over the shield end and being crimpable thereonto electrically connecting the shield end between the annular section and said ferrule means; and insulating sleeve means having contact-engaging means and cable-engaging means, said contact-engaging means being positioned onto said outer contact means and said cable-engaging means being profiled for engaging the cable adjacent said ferrule means;

said outer contact means including an inwardly directed projection means extending axially rearwardly from the front edge of said forward section means, and said forward section means being continuous at said projecton means; and said outer contact means being secured onto said housing means with said projection means being in alignment with said recess means of said housing means, whereby said housing means is polarized with said receptacle connector when said projection means is disposed within said channel of said receptacle connector upon mating therewith.

2. A plug connector as set forth in claim 1 wherein said outer contact means comprises a pair of clamshell means securable around said housing means.

3. A plug connector as set forth in claim 2 wherein said clamshell means are securable around said housing means after said electrical terminal means secured to said electrical conductors are positioned in said terminal passageways of said housing means.

4. A plug connector as set forth in claim 1 wherein said projection means extends into said recess means of said housing means.

5. A plug connector as set forth in claim 1 wherein said outer contact means comprises a pair of clamshell means, said projection means is disposed on at least a forward section means of one of said clamshell means and extends into said recess means of said housing means, and said ferrule means secures said clamshell means onto said housing means.

* * * * *